United States Patent [19]

Linz et al.

[11] Patent Number: 4,957,133

[45] Date of Patent: Sep. 18, 1990

[54] FLUSHING UNIT

[75] Inventors: Dieter Linz, Bad Soden; Peter Elsner, Frankfurt, both of Fed. Rep. of Germany

[73] Assignee: Messer. Griesheim, Fed. Rep. of Germany

[21] Appl. No.: 385,189

[22] Filed: Jul. 26, 1989

[30] Foreign Application Priority Data

Aug. 12, 1988 [DE] Fed. Rep. of Germany ... 8810259[U]

[51] Int. Cl.[5] ..... B08B 9/06; F17D 3/00

[52] U.S. Cl. ..... 137/240; 134/166 C; 222/148

[58] Field of Search ..... 137/238, 240; 134/166 C, 167 C, 168 C, 169 C; 222/148; 251/335.2

[56] References Cited

U.S. PATENT DOCUMENTS

| | | | |
|---|---|---|---|
| 3,474,816 | 10/1969 | Burgess | 137/238 |
| 4,120,331 | 10/1978 | Krivanek, III | 137/240 |
| 4,169,486 | 10/1979 | Otteman et al. | 137/240 |
| 4,351,354 | 9/1982 | Hilterhaus et al. | 137/240 |
| 4,383,547 | 5/1983 | Lorenz et al. | 137/240 |
| 4,554,942 | 11/1985 | Williams et al. | 137/240 |
| 4,768,543 | 9/1988 | Wienke et al. | 137/240 |

FOREIGN PATENT DOCUMENTS

| | | | |
|---|---|---|---|
| 258276 | 10/1987 | Japan | 251/335.2 |

*Primary Examiner*—George L. Walton

*Attorney, Agent, or Firm*—Connolly & Hutz

[57] ABSTRACT

A flushing unit has an extraction borehole for process gases and a flushing gas line, which can be connected via a flushing gas connection to a flushing gas supply. In order for only one fitting to be flushed by a circulation flushing operation with an inert gas or a flushing gas, the flushing unit has a flushing gas outlet which is connected to the extraction borehole, and which is opened or closed with a stop valve.

7 Claims, 2 Drawing Sheets

FLUSHING UNIT

BACKGROUND OF INVENTION

Compressed gas cylinder connections, which are screwed onto the cylinder valve by means of a coupling nut, serve to link compressed gas cylinders to filling or extraction systems. A connection line leads from the compressed gas cylinder connection to the filling or extraction system. When the compressed gas cylinder is empty, the cylinder valve is closed and the compressed gas cylinder connection is taken away from the cylinder valve. Then, a full compressed gas cylinder is connected and the cylinder valve is opened. After that, gas can continue to be admitted to the filling or extraction system.

This simple exchange of the compressed gas cylinders is not possible with gases that are explosive, self-igniting or especially with toxic gases whose threshold limit values, depending on the medium, are lower than 0.1 ppm. The reason lies in the fact that in the dead spaces, especially between the cylinder valve and the compressed gas cylinder connection as well as in the compressed gas cylinder connection and in the following connection lines themselves, there is still so much gas that it cannot be released to the atmosphere without risk. Therefore, the design of these mechanisms is increasingly being influenced by the necessity of avoiding the risks by means of intensive flushing with a flushing gas. Furthermore, in many cases it is necessary to remove atmospheric air (moisture) that has entered the system by means of flushing, in order to prevent salt formation when corrosive gases are used. For example, it is a generally known measure to equip the cylinder valve with a flushing gas line. In this case, the flushing gas line is then equipped with a flushing valve (West German Pat. No. 36 22 527).

According to West German Utility Model No. 86 22 871, the proposal is made to equip the compressed gas cylinder connection with a flushing gas line. The flushing gas line is connected to a flushing gas supply via a flushing connection.

However, the flushing gas has to flow via these flushing gas connections into the flushing gas line and it has to continue to flow via the extraction borehole of the cylinder valve into the adjacent connection lines and fittings, until the entire process gas has been displaced.

SUMMARY OF INVENTION

The invention is based on the object of creating a flushing unit which makes it possible to displace the process gas exclusively out of the dead spaces of a fitting, especially of a cylinder valve.

The advantages achieved by means of the invention lie in the fact that, instead of having to flush numerous fittings and connection lines, it is possible to flush only the cylinder valve by an open, circulation flushing operation. During the flushing operation with an inert gas or a flushing gas, the extraction line is shut off by means of a stop valve, so that no process gas can escape from the linked connection lines and from the gas extraction fittings and no air or moisture can enter them. In this arrangement, it is advantageous that no flushing gas enriched with moisture and process gas can flow through the gas extraction fittings such as, for example, the pressure regulator or the finemetering valve.

Further advantages arise in view of the fact that the flushing gas inlets and outlets as well as the extraction borehole can be opened or closed by means of the flushing unit so that, if so desired, e.g. if the empty compressed gas cylinder contains the same process gas as the new compressed gas cylinder to be connected, then only the cylinder valve can be flushed, whereas on the other hand, it is also possible to flush the entire filling or extraction system.

Due to the fact that the stop valves and the flushing gas inlet and outlet are combined in one housing, the dead spaces are reduced and operation is simplified. Impurities such as particles and moisture are minimized, the flushing gas consumption is reduced and the flushing time needed when replacing compressed gas cylinders is cut down.

THE DRAWINGS

DETAILED DESCRIPTION

Figure 1:
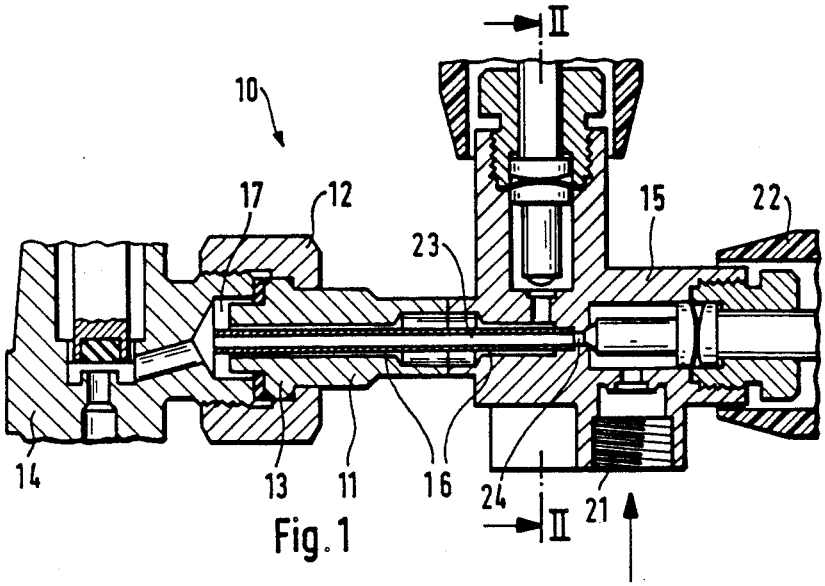
FIG. 1 is a longitudinal section of the flushing unit according to the invention.
Figure 2:
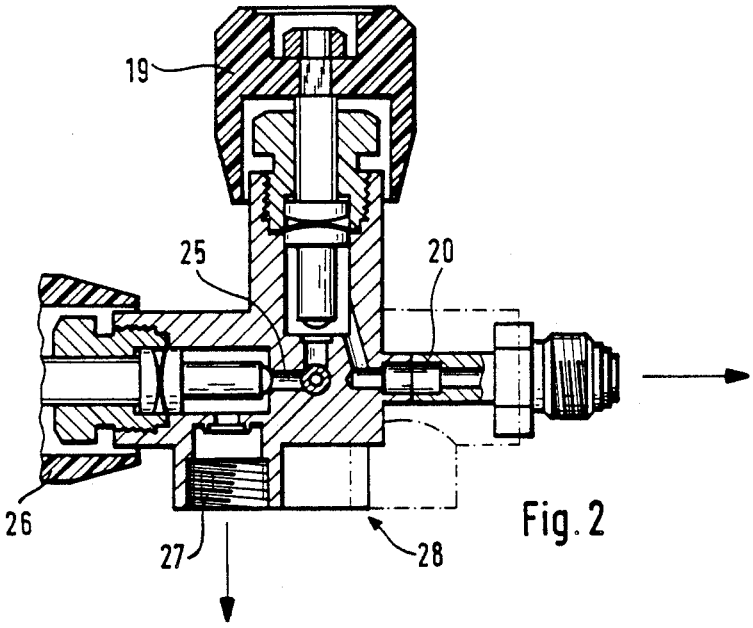
FIG. 2 is a cross section along line II—II of FIG. 1.

The flushing unit 10 shown in FIGS. 1 and 2 consists of a connection piece 11, on which a coupling nut 12 is positioned. By means of the coupling nut 12, which can be placed against a flange 13 that stands out radially from the connection piece, the flushing unit 10 is screwed onto the cylinder valve 14. The housing 15 of flushing unit 10 is, for example, welded onto the connection piece 11.

The connection piece 11 and the housing 15 have an extraction borehole 16, which is connected with the outlet 17 of the cylinder valve 14. According to the invention, the extraction borehole 16 is connected to a process gas outlet 20 via a stop valve 19 located in the housing 15.

Furthermore, the housing 15 has a flushing gas inlet 21, which is connected to the outlet 17 of the cylinder valve 14 via a stop valve 22 located in the housing 15. The connection is via a borehole 24 and a pipe 23, which runs through the extraction borehole 16 and which is located in the housing 15.

The outlet 17 of the cylinder valve is connected to a flushing gas outlet 27 via a borehole 25 that branches off from the extraction borehole 16 and via a stop valve located in the housing 15.

In the figures, the stop valves 19, 22 and 26 are shown as manually actuated valves. It is self-evident and does not require any detailed explanation that these stop valves can also be actuated automatically, for example, pneumatically or hydraulically.

With the flushing unit according to the invention, compressed gas cylinders with hazardous contents can be replaced safely. For this purpose, first of all, the cylinder valve 14 and the stop valve 19 are closed, and then a flushing gas or inert gas is allowed to flow in through the flushing gas inlet 21. Since stop valve 22 and stop valve 26 are open, this gas passes through the borehole 24 and the pipe 23 into the connection 17 of the cylinder valve 14. The process gas located in the dead space there is mixed with the flushing gas and flows through the borehole 25 to the flushing gas outlet 27. The flushing gas is allowed to flow through the flushing gas inlet 21 until all of the process gas in the cylinder valve and in the flushing unit has been displaced. Then the flushing gas supply is cut off by means of closing the stop valve 22. After that, the compressed gas cylinder can then be safely replaced with a freshly filled one.

In order to achieve a compact design and simple operation of the flushing unit, it is advantageous for the stop valve 22 to be positioned on the same horizontal plane diagonally from the stop valve 26 and on the same center axis as the pipe 23. The stop valve 19 is positioned, in the housing 15, in the intersection area of the center axes of the stop valves 22 and 26 at right angles to these axes. The flushing gas inlet 21 and the flushing gas outlet 27 emerge from the housing 15 on the same side 28.

It is, of course, also advantageously possible for all of the stop valves 19, 22, 26 to be positioned on the same horizontal plane diagonally from each other. In this case, the stop valve 22 is advantageously positioned across from the connection 12, 13, 17 of the cylinder valve, whereas the stop valves 19, 26 are positioned to the left or right of the cylinder valve. As a result of this measure, the process gas flows perpendicular to the stop valves 19, 22, 26 and across from the flushing gas inlet 21 or flushing gas outlet 27 out of the flushing unit and to a fitting, for example, a pressure regulator. The pressure gauges associated with the pressure regulator are advantageously arranged in the proper reading position.

In order to achieve rapid and effective flushing of the cylinder valve, it is highly advantageous for the flushing unit 10 to have a flushing gas outlet 27, so that the flushing can be undertaken by a circulation flushing operation.

Under operating conditions, as shown in FIGS. 1 and 2, the stop valves 22 and 26 are closed. When the cylinder valve is open, process gas flows via the extraction borehole 16 and the open stop valve 19 to the process gas outlet 20.

Figure 3:
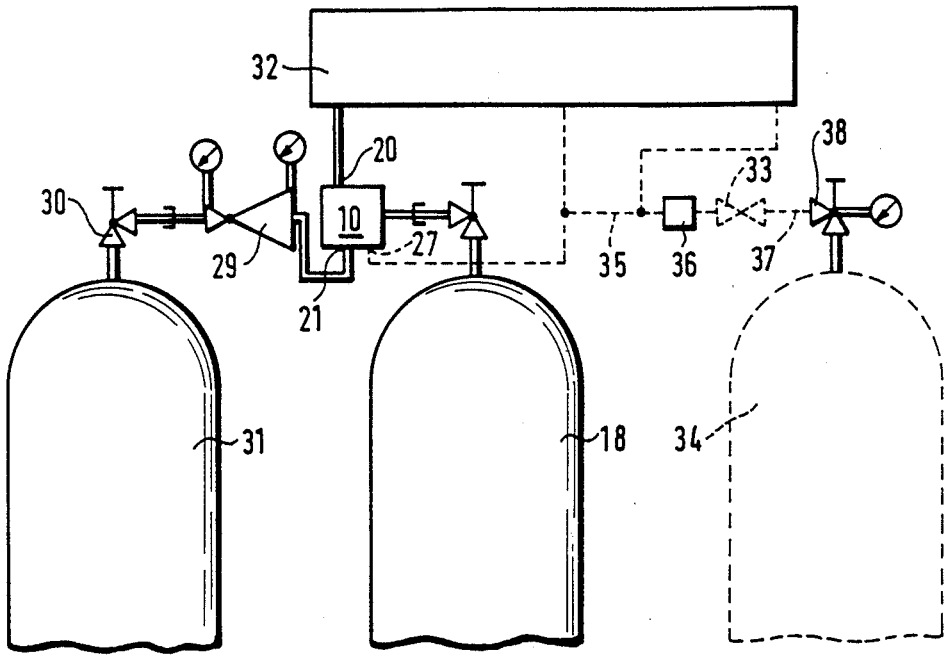
FIG. 3 is a layout for process gases with a waste-gas cylinder.

FIG. 3 shows a layout for the process gas with a flushing unit 10, whose flushing gas inlet 21 in connected with a flushing gas cylinder 31 via a pressure reducer 29 and a cylinder valve 30. The connection 11, 12, 13 of the flushing unit 10 is connected to the cylinder valve 14 of the process gas cylinder 18. The flushing unit is connected to a gas extraction or filling system 32 with the process gas outlet 20, which emerges in FIG. 3, for example, from the upper side of the flushing unit. According to the invention, the proposal is also made to connect the flushing gas outlet 27 via a flap valve 33 with an empty waste-gas cylinder 34 or a waste-gas tank into which the process-flushing gas mixture or the atmosphere-flushing gas mixture flows during the flushing operation. In this case, a pressure intensifier 36 can be inserted into the connection line 35 between the flushing unit 10 and the waste-gas cylinder 34; the flushing gas pressure in the secondary pressure line is increased by means of this pressure intensifier 36 when the pressure in the flushing gas cylinder falls and the pressure in the waste-gas cylinder rises. As a result of this measure, the waste-gas cylinder can be filled, even when the flushing gas pressure is decreasing. Another process consists of liquefying the process-flushing gas mixture or the atmosphere-flushing gas mixture before it is eliminated via a waste-gas tank. In addition to liquefying, the process-flushing gas mixture or the atmosphere-flushing gas mixture can also be solidified by means of a chemical-reaction process and likewise eliminated via a waste-gas tank. With all of these disposal techniques, toxic components can be neutralized by means of the appropriate chemicals. After the waste-gas cylinder 34 is filled, its cylinder valve 38 is closed, it is disconnected from the secondary pressure line 37 and the full waste-gas cylinder is replaced with an empty waste-gas cylinder.

What is claimed is:

1. A flushing unit for gas cylinders comprising a solid unitary block housing, said housing having connecting means for connection to the cylinder valve of the gas cylinder, an extraction borehole in said housing, one end of said extraction borehole terminating at and communicating with the outlet of said cylinder valve, said extraction borehole having an outlet within said housing whereby a process gas may flow from said cylinder and through said extraction borehole when said cylinder valve is open, a process gas stop valve at the other end of said extraction borehole and being spaced from said cylinder valve in said housing selectively opening and closing said extraction borehole to selectively permit and prevent the process gas from being discharged from said extraction borehole, a flushing gas inlet in said housing, a flushing gas line in said housing located parallel to said extraction borehole over substantially the entire length of said flushing gas line, a flushing gas inlet stop valve in said housing adjacent said process gas stop valve in said housing selectively opening and closing said flushing gas line, said flushing gas line communicating with said flushing gas inlet and said cylinder valve, one end of said flushing gas line terminating at said cylinder valve outlet, a space being created in said housing at said outlet of said cylinder valve where said outlet of said cylinder valve communicates with said one end of said extraction borehole and said one end of said flushing gas line, a flushing gas outlet in said housing communicating with said extraction borehole whereby said extraction borehole comprises an outlet passage for the flushing gas when the flushing gas enters said space, a flushing gas outlet stop valve adjacent said process gas stop valve in said housing selectively opening and closing said flushing gas outlet whereby a flushing gas may be supplied into said housing when said flushing gas outlet stop valve is open and said process gas stop valve is closed to flow through said flushing gas line and into said cylinder valve outlet at said space to mix with any process gas in said cylinder valve outlet and in said space and then flow out of said housing through said extraction borehole and said flushing gas outlet until all of the process gas has been displaced and whereby the space requirements and flushing gas requirements are minimized.

2. Flushing unit according to claim 1, characterized in that said flushing gas line is located coaxially within said extraction borehole.

3. Flushing unit according to claim 2, wherein said cylinder valve outlet communicates with said flushing gas outlet by a borehole which branches from said extraction borehole.

4. Flushing unit according to claim 1, in combination therewith, a flushing gas cylinder for connection to said flushing gas inlet, a process gas cylinder having said cylinder valve connected by said connecting means to said housing, and a waste-gas line for connection between said flushing gas outlet and a waste-gas cylinder.

5. Flushing unit according to claim 4, characterized in that there is a flap valve in said waste-gas line and a cylinder valve disposed on said waste-gas cylinder.

6. Flushing unit according to claim 1, wherein said housing comprises a two-piece unit welded together.

7. Flushing unit according to claim 1, wherein said flushing gas line is located within said extraction borehole.

* * * * *